United States Patent [19]

Breakey et al.

[11] Patent Number: 4,572,381

[45] Date of Patent: Feb. 25, 1986

[54] BRACKET BOARD

[76] Inventors: Fred B. Breakey, 2901 Silver Lake Ave., Tampa, Fla. 33614; Leo D. Barber, P.O. Box 244, Dover, Fla. 33527; Richard L. Chapman, P.O. Box 151028, Tampa, Fla. 33684; Norman Godin, 11906 E. Park Ave., Seffner, Fla. 33584; Robert Henry, Rte. 3, Box 1971, Odessa, Fla. 33556; Claude Jackson, 3201 Granada, Tampa, Fla. 33629; John Romberger, 606 Rosier Rd., Brandon, Fla. 33511; Rudolph Seidl, 8207 N. Orleans, Tampa, Fla. 33604

[21] Appl. No.: 427,625

[22] Filed: Sep. 29, 1982

[51] Int. Cl.[4] ..... A47F 5/08

[52] U.S. Cl. ..... 211/94; 248/223.4

[58] Field of Search ..... 248/220.2, 222.4, 223.4, 248/224.1, 224.2, 224.4, 475 R, 489; 211/90, 94, 87, 88; 52/36; 108/108, 152

[56] References Cited

U.S. PATENT DOCUMENTS

| | | | |
|---|---|---|---|
| 1,026,475 | 5/1912 | Tarbuck | 269/100 |
| 1,210,034 | 12/1916 | Bishop | 248/489 |
| 3,180,528 | 4/1965 | Balint | 248/205 A |
| 3,235,218 | 2/1966 | Graham | 248/489 |

FOREIGN PATENT DOCUMENTS

| | | | |
|---|---|---|---|
| 312150 | 4/1919 | Fed. Rep. of Germany | 211/87 |
| 2296139 | 8/1976 | France | 248/222.1 |
| 2450582 | 11/1980 | France | 211/94 |
| 612067 | 11/1948 | United Kingdom | 248/201 |
| 707694 | 4/1954 | United Kingdom | 108/108 |

*Primary Examiner*—J. Franklin Foss
*Assistant Examiner*—Robert A. Olson
*Attorney, Agent, or Firm*—Frijouf, Rust & Pyle

[57] ABSTRACT

A bracket board is disclosed for supporting a bracket in which a base has disposed thereon a plurality of parallel horizontal facing panels. Each of the facing panels is separated from an adjacent facing panel by a horizontal groove. A reinforcing Z-section member is disposed in each of the horizontal grooves with the upper arm of each Z-section member being sandwiched between the base and an undercut on the lower edge of each facing panel.

15 Claims, 7 Drawing Figures

BRACKET BOARD

BACKGROUND OF THE INVENTION

1. Field of the Invention

This invention relates to a bracket board for supporting brackets for shelves and the like.

2. Description of the Prior Art

In order to present marketable products to the buying public various attempts have been made to display merchandise in a pleasing and aesthetic manner. One of the more popular methods of displaying goods for sale is that of providing a board including a plurality of holes defined by the board for the reception therein of pegs from which merchandise is suspended. Such boards are manufactured under the registered trademark PEGBOARD. The PEGBOARD cooperates with various pegs or display brackets which are inserted into the PEGBOARD so that merchandise can be hung from these pegs or display brackets. Various modifications to this basic concept have been proposed including foraminous panels having adjacent holes which receive threaded stems of display pegs.

PEGBOARD display devices, although presenting merchandise in a more pleasing manner than that of counter top displays, suffered from drawbacks such as the problem of securely fastening the stem within the corresponding PEGBOARD holes. Relatively complex arrangements were proposed for securing the display pegs within the PEGBOARD holes including devices in which wing nuts were provided to cooperate with the stem of the display bracket. However, these modifications often necessitated access to the back of the PEGBOARD if the display brackets were to be relocated relative to the PEGBOARD.

A more recent proposal for displaying merchandise in an aesthetic manner includes a base having a plurality of horizontal facing panels, each facing panel being separated from the adjacent facing panel by a horizontal groove. Each groove has a recess for receiving a suitably shaped tab of a bracket which may be hooked through the groove and recess to support the bracket relative to the bracket board. While this more recent proposal has overcome the problem of moving brackets relative to the bracket board without having to access the back of the bracket board, certain disadvantages have been experienced in this particular type of display bracket board. Unfortunately, this prior art system had only limited strength and could not support brackets required to hold heavy objects. To overcome this limited strength, some in the prior art have utilized metallic inverted J-members within the grooves to add additional strength. With the use of an inverted J-section member, firstly the longer arm of the J-section is visible from the front of the bracket board which tends to detract from the otherwise pleasant wood finish of the bracket board. Secondly, the J-section member is located within the groove merely by compression between the base and adjacent facing panel. The J-section member is not securely located until installation of the bracket board to the wall by means of screws passing through holes in the longer arm of the J-section member and through the base into the wall. Thirdly, in the prior art proposal the holes in the longer arm of the J-section member must be countersunk otherwise the head of the screw used in the installation of the bracket board would foul the display bracket when inserted within the groove. With the exception of the screw heads used in the installation of the bracket board, the bracket board of the present invention provides a pleasant all wood appearance.

Therefore it is the primary object of this invention to provide a bracket board that overcomes the aforementioned inadequacies and disadvantages of the prior art devices by having the Z-section member hidden when viewed from the front of the bracket board thus providing an improvement which significantly contributes to the aesthetic appeal of the bracket board.

Another object of this invention is to provide an improved means of manufacturing a bracket board whereby the Z-section members are securely located between a base and a plurality of facing panels by fastening devices inserted from the rear of the bracket board prior to installation of the bracket board to a wall.

Another object of this invention is the provision of open access to the base through the grooves. The base may have holes drilled therein for the insertion of screws to fasten the bracket board to a wall thus avoiding the need of countersunk drill holes in the sectional member.

The foregoing has outlined some of the more pertinent objects of the present invention. These objects should be construed to be merely illustrative of some of the more prominent features and applications of the invention. Many other beneficial results can be obtained by applying the disclosed invention in a different manner or modifying the invention within the scope of the disclosure. Particularly with regard to the use of the invention disclosed herein, this should not be construed as limited to bracket boards for supporting display brackets but should include bracket boards for supporting shelf arrangements, pictures, clothing hooks, plant displays and the like.

SUMMARY OF THE INVENTION

The bracket board of the present invention is defined by the appended claims with a specific embodiment shown in the attached drawing. For the purpose of summarizing the invention, the invention relates to bracket boards for supporting display brackets. The bracket board comprises a base laminated with a plurality of parallel, horizontally disposed facing panels, each facing panel being separated from an adjacent panel by a groove. The lower edge of each facing panel is undercut to receive therein a Z-section member, the upper arm of which is secured between the base and the undercut of the facing panel. In a more specific embodiment of the invention, the Z-section member is of metal and has holes drilled in the upper arm thereof to cooperate with screws or staples inserted from the rear of the bracket board through the base and the drilled holes of the member towards the facing panel.

One method of installing the bracket board of the present invention to a sheetrock wall of 2 inch by 4 inch metal or wood stud construction includes applying four horizontal beads of adhesive spaced vertically approximately 2 feet apart. The bracket board is then placed in position adjacent the wall and secured to the wall by wood screws inserted through the grooves and through the base into the wall. The base may be predrilled with countersunk holes for the reception of bugle head screws, anchor bolts, or the like. Furring strips may be provided between the base and the wall to facilitate installation of the bracket board, particularly if the wall is uneven.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and specific embodiment disclosed may be readily utilized as a basis for modifying or designing other devices for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following description taken in conjunction with the accompanying drawings in which.

Similar reference characters refer to similar parts throughout the several views of the drawings.

DETAILED DESCRIPTION

Figure 1:
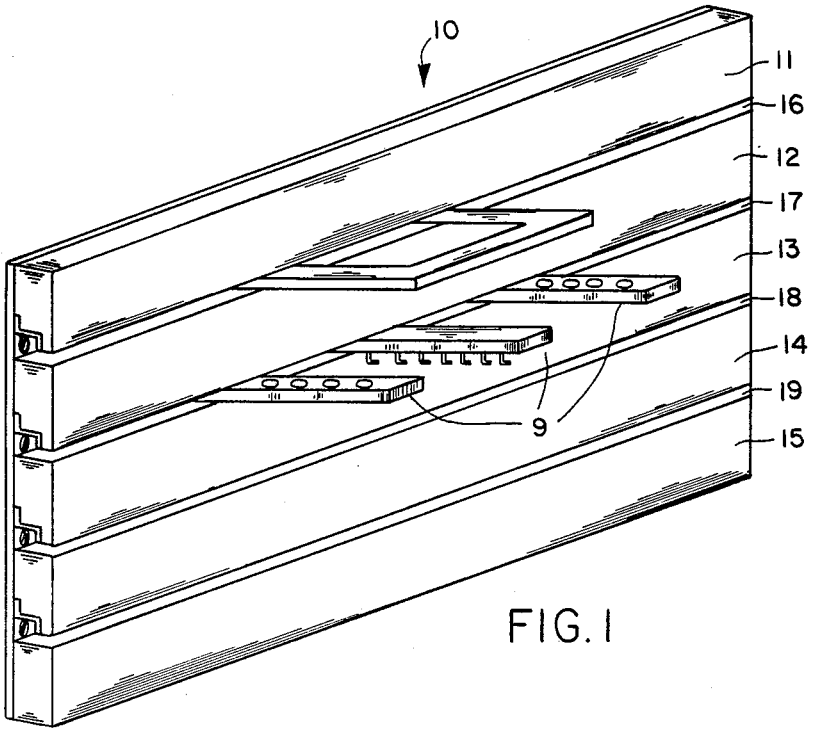
FIG. 1 is a perspective view of a bracket board of the present invention showing various display brackets supported thereon.

FIG. 1 is a perspective view of a bracket board generally designated 10 having a plurality of facing panels 11, 12, 13, 14 and 15. The adjacent facing panels 11 and 12, 12 and 13, 13 and 14, 14 and 15 are separated from each other by grooves 16, 17, 18 and 19, respectively. Various display bracket members 9 are illustrated in FIG. 1 of the drawing, but these do not constitute part of the present invention.

Figure 2:
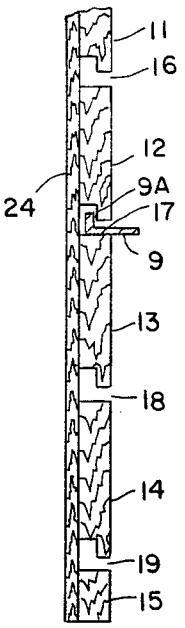
PRIOR ART FIG. 2
FIG. 2 is a side sectional view of a prior art bracket board.

FIG. 2 is a side elevation of a prior art bracket board having a base 24 and facing panels 11–15. Adjacent panels 11 and 12, 12 and 13, 13 and 14 and 14 and 15 define grooves 16–19, respectively. The grooves 16–19 are undercut to receive the tab 9A of a bracket 9.

Figure 3:
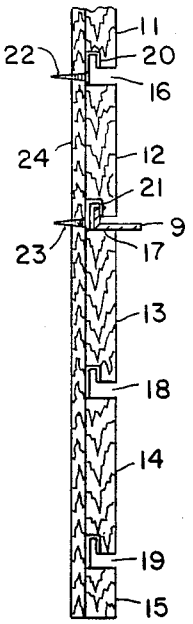
PRIOR ART FIG. 3
FIG. 3 is a side sectional view of a prior art bracket board including J-section members.

The grooves 16–19 as shown in FIG. 2 are not reinforced so the weight that can be supported on a bracket inserted into such a bracket board is necessarily limited to the strength of the facing board. In order to overcome the problem of the inherent lack of strength of the prior art bracket board as shown in FIG. 2, inverted J-section reinforcement members 20 and 21 have been proposed as shown in FIG. 3. These reinforcement members 20 and 21 are located within grooves 16 and 17 by means of screws 22 and 23, respectively to receive the bracket 9.

The reinforcement members 20 and 21 overcame the problem of the lack of strength of the bracket board, but in doing so, presented a further problem in that the J-section members showed from the front of the bracket board. Also the J-section members required countersunk holes for the reception of screws 22 and 23.

Figure 4:
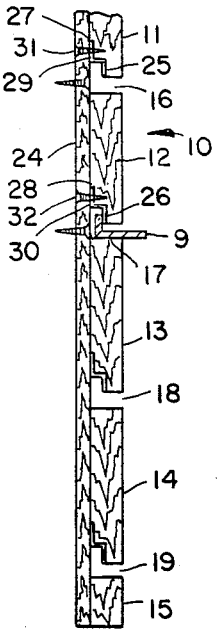
FIG. 4 is a vertical cross-sectional view of the bracket board of the present invention with Z-section members incorporated therein.

FIG. 4 is a vertical cross-sectional view of the bracket board 10 of the present invention and comprises a base 24 having facing panels 11, 12, 13, 14 and 15 affixed thereto. Adjacent facing panels 11 and 12, 12 and 13, 13 and 14, 14 and 15 are separated by grooves 16, 17, 18 and 19 respectively. Z-section members 25 and 26 are secured between base 24 and facing panels 11 and 12, respectively. The upper arms 27 and 28 of members 25 and 26 have holes 29 and 30 drilled therein to receive wood screws 31 and 32 respectively, inserted from the rear of the bracket board through the base 24 towards the facing panels 11 and 12, respectively.

Figure 5:
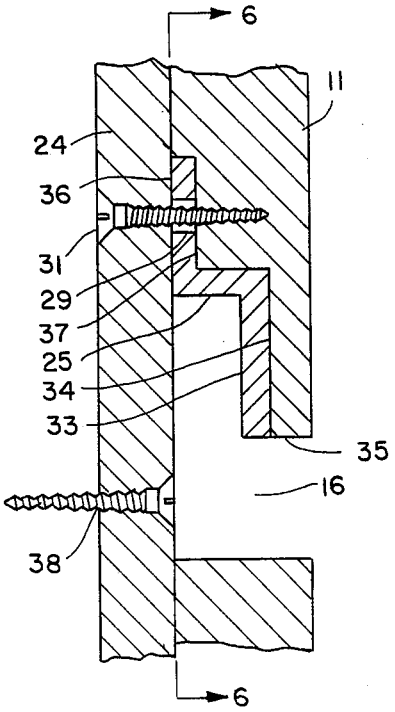
FIG. 5 is an enlarged vertical cross-section of a Z-section member.

FIG. 5 is an enlarged vertical cross-section of the Z-section member of the present invention showing a first and a second facing panel 11 and 12 and the Z-section member 25 secured between the bases 24 and facing panel 11 by means of wood screw 31 inserted through base 24 and through drilled hole 29 into the facing panel 11. The lower arm 33 of the Z-section member 25 is disposed proximate an undercut 34 of the lower edge 35 of the first facing panel 11. The upper arm 36 of member 25 is disposed proximate a second undercut 37 of the facing panel 11 on the side of the facing panel adjacent the base 24. Flathead woodscrew 38 is inserted between groove 16 through base 24 to anchor bracket board 10 to a wall (not shown).

Figure 6:
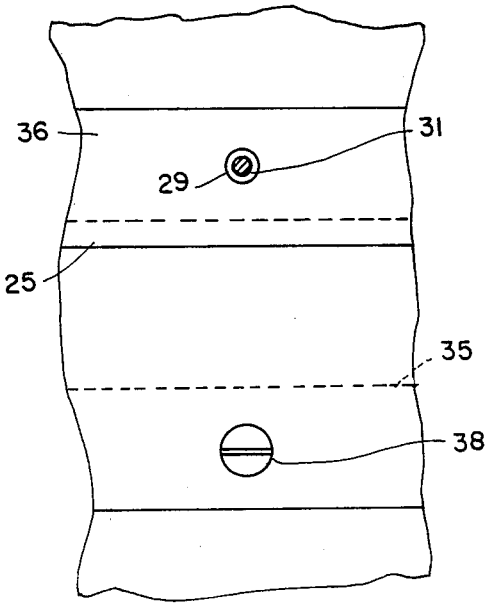
FIG. 6 is a vertical section taken on line 6—6 of FIG. 5.

FIG. 6 is a vertical section taken on line 6—6 of FIG. 5 and shows in detail the drilled hole 29 in the upper arm 36 of Z-section member 25. In a typical embodiment of the present invention, the base may be quarter-inch plywood and the facing panels may be one-half inch plywood. Various types of woods can be utilized as veneers for the facing panels, including gum, ash, birch, red oak or planer. The reinforcing Z-section members are preferably made of a metal or plastics material and may be secured proximate the first undercut by means of wood screws, rivets or staples.

Figure 7:
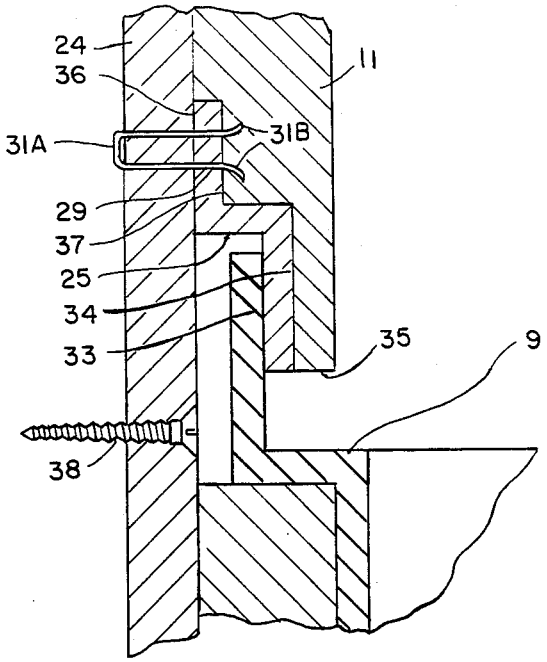
FIG. 7 is a similar view to that of FIG. 6 but shows the tab of a bracket inserted into the recess.

As an alternative to the use of screw 31, a staple 31A as shown in FIG. 7 can be used to fasten the facing panel 11 to the base 24. FIG. 7 also shows the tab of a bracket inserted within the first undercut portion 34 of facing panel 11. It has been found that the staples are deformed at 31B upon passing through the metallic Z-section member to secure the Z-section member to the base 24 and the facing panel 11.

During the manufacture of the bracket board, the base is assembled in a precision jig and the facing panels secured adjacent the base to constitute a further lamination of the base. Parallel grooves are precision cut through the plywood panel to provide a plurality of parallel facing panels having parallel grooves therebetween. By using a precision jig, alignment of the grooves of subsequently produced bracket panels are ensured. Furthermore by the use of a single plywood panel, each of the resulting facing panels will have a matching woodgrain finish which further adds to the aesthetic appeal of the finished product.

An important aspect of the present invention is the provision of a bracket board which, when installed, presents an appearance that is pleasing to the eye. With the exception of the wall fastening screws, the bracket board presents an all wood appearance. Additionally, the bracket board of the present invention provides means for securely locating display brackets thereto and reduces the complexity of manufacture of prior art proposals by avoiding the need for countersinking the drilled holes in the reinforcing member as shown in FIG. 3.

Another important feature of the present invention resides in the added strength over the prior art as shown in FIGS. 2 and 3. The Z-section member is secured between the base and the facing panel by screws inserted from the rear of the base through the Z-section member towards the facing panel thus holding these three elements together. In the prior art bracket board of FIG. 3, only the J-section member and the base are held together by screws.

The present disclosure includes that contained in the appended claims as well as that of the foregoing description. Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

The present disclosure includes that contained in the appended claims as well as that of the foregoing description. Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A bracket board for supporting a bracket, comprising in combination:

a base;

a first and a second facing panel;

means connecting said first and second facing panels to said base for defining a groove therebetween;

a lower edge of said first facing panel having a first undercut;

said first undercut of said first facing panel defining a second undercut disposed adjacent said base;

a reinforcing Z-section member being disposed within said first and second undercuts;

an upper arm of said Z-section member being located between said base and said first facing panel and extending within said second undercut;

a lower arm of said Z-section member extending within said first undercut of said first facing panel and defining a space between said lower arm of said Z-section member and said base; and said means connecting said first and second facing panel to said base includes mechanical fastening means secured to said first facing panel and said base and extending through said Z-section member for providing a reinforcement to said first undercut when the bracket is inserted through said groove into said space between said lower arm of said Z-section member and said base.

2. A bracket board as set forth in claim 1, wherein said fastening means comprises a plurality of screws.

3. A bracket board as set forth in claim 1, wherein said fastening means comprises a plurality of rivets.

4. A bracket board as set forth in claim 1, wherein said fastening means comprises a plurality of bolts.

5. A bracket board as set forth in claim 1, wherein said fastening means comprises a plurality of staples.

6. A bracket board as set forth in claim 1, wherein said facing panels are disposed substantially horizontally.

7. A bracket board as set forth in claim 1 wherein said bracket board is fastened to a wall by means of a wall fastening means inserted through said grooves and through said base into said wall.

8. A bracket board as set forth in claim 7, wherein said wall fastening means is inserted through holes drilled in said base.

9. A bracket board as set forth in claim 8, wherein said wall fastening means comprises a plurality of wood screws.

10. A bracket board as set forth in claim 8, wherein said wall fastening means comprises a plurality of staples.

11. A bracket board as set forth in claim 8, wherein said wall fastening means comprises a plurality of nails.

12. A bracket board as set forth in claim 8, wherein said wall fastening means comprises a plurality of wall anchors.

13. A bracket board as set forth in claim 1, wherein said facing panels are of wood.

14. A bracket board as set forth in claim 1 wherein said Z-section members are of metal.

15. A bracket board as set forth in claim 1 wherein said Z-section members are of a plastics material.

* * * * *

UNITED STATES PATENT AND TRADEMARK OFFICE

CERTIFICATE OF CORRECTION

PATENT NO. : 4,572,381

DATED : February 25, 1986

INVENTOR(S) : Breakey et al

It is certified that error appears in the above-identified patent and that said Letters Patent are hereby corrected as shown below:

Column 4, line 20, before "facing" insert --the first--.

Column 4, line 24, delete "an" and insert therefor --a first--.

Claim 7, delete "grooves" and insert therefor --groove--.

Claim 14, delete "members" and insert therefor --member--.

Claim 15, delete "members" and insert therefor --member--.

Signed and Sealed this

*Twenty-fourth* Day of *June 1986*

[SEAL]

*Attest:*

DONALD J. QUIGG

*Attesting Officer*

*Commissioner of Patents and Trademarks*